United States Patent [19]

Walser

[11] Patent Number: 4,637,339

[45] Date of Patent: Jan. 20, 1987

[54] ELECTRODE ARRANGEMENT FOR A COATING INSTALLATION

[75] Inventor: Felix Walser, Hinwil, Switzerland

[73] Assignee: Prazisions-Werkzeuge AG, Ruti, Switzerland

[21] Appl. No.: 774,701

[22] Filed: Sep. 11, 1985

[30] Foreign Application Priority Data

Sep. 11, 1984 [CH] Switzerland ..... 4335/84

[51] Int. Cl.[4] ..... B05D 1/06

[52] U.S. Cl. ..... 118/622; 118/627; 118/629

[58] Field of Search ..... 118/622, 627, 629

[56] References Cited

FOREIGN PATENT DOCUMENTS 2097761 7/1981 France .
2028171 3/1980 United Kingdom .

*Primary Examiner*—Richard Bueker
*Attorney, Agent, or Firm*—Antonelli, Terry & Wands

[57] ABSTRACT

An electrode arrangement for a coating installation which functions with the aid of an electric field. The electrode arrangement includes a pair of electrodes for creating an electrostatic field with at least one of the electrodes being fashioned with a sharp edge or tip. The electrode is disposed in a conduit and excess pressure or a vacuum is applied to the conduit with respect to the pressure in the coating chamber of the coating installation in an area of the electrode so that the coating medium is either prevented from coming into contact with the electrode or is suctioned off through the conduit system. By virtue of the provision of the suction removal means for the excess coating medium, the conduit system can be placed in direct communication with the ambient pressure. Additionally, the electrode may be arranged in a vacuum zone of the coating chamber.

3 Claims, 2 Drawing Figures

ELECTRODE ARRANGEMENT FOR A COATING INSTALLATION

Figure 1:
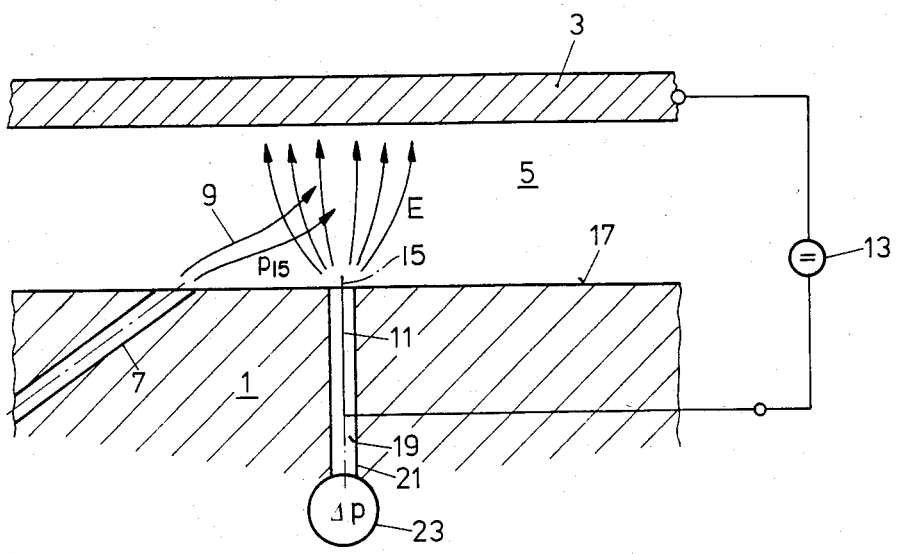

The present invention relates to an electrode arrangement and use thereof and, more particularly, to an electrode arrangement for a coating installation wherein a coating medium is driven against an article to be coated in a coating chamber, with the coating being at least supported by an electric field applied between at least one electrode and the article, and wherein an ambient pressure in the coating chamber zone where the electric field is applied differs from the ambient pressure in the coating installation, and with a conduit arrangement being provided in a region or area of the electrodes so as to enable by a blowing and/or suction action to either remove or maintain the coating medium away from the electrode.

In, for example, French Patent No. 2,097,761 or British Patent No. 2,028,171, coating installations of the aforementioned type are proposed for internally coating cylindrical bodies such as, for example, metallic cans, with the electrodes for providing an electric field being protected from contamination with a coating medium by virtue of the provision of conduits supplying compressed air, which conduits terminate in a zone or area of the electrodes. The compressed-air supply conduits extend axially through a cantilever or outrigger arm and terminate in the arm, with the arm holding the nozzle arrangement for the coating medium as well as processing tools arranged upstream thereof in the interior of the cylindrical bodies. Additionally, the supply conduits for the coating medium extend axially through the arm too, the arm having to carry all of the working units which must be activated within the cylindrical bodies and after the cylindrical bodies have been welded along longitudinal seams thereof. A source of compressed air, that is, an active generator or compressor, is utilized for feeding the supply conduits that terminate in the zone or area of the electrodes with such source being determined also in dependence upon the length of the supply conduits.

The aim underlying the present invention essentially resides in providing a simplified electrode arrangement for a coating installation of the aforementioned type.

In accordance with advantageous features of the present invention, an electrode arrangement for a coating installation is provided wherein the coating medium, in a coating chamber, is driven against an article to be coated. The coating action is at least supported by an electric field applied between at least one electrode and the article to be coated. A pressure, ambient in the coating chamber zone, where the electric field is applied, is different with respect to an ambient installation pressure, and a conduit arrangement is provided in an area or region of the electrode by which, with a blowing and/or suction action, the coating medium is removed from or kept away from the electrode. The conduit arrangement is in communication with the surrounding or environment of the coating installations so as to create a differential pressure source.

Advantageously, in accordance with further features of the present invention, the electrode is constructed as a wire electrode and extends at least, at an end thereof, within a conduit constituting the conduit arrangement.

The present invention exploits that a pressure differential with respect to the ambient pressure of the coating installation exists in the coating chamber already due to the injection of coating medium under pressure. If the coating installation, in a conventional manner, is provided with a recovery unit with a suction conduit arrangement, located downstream with respect to the feeding direction of the article to be coated, to recover coating medium that did not adhere to the article, then the pressure profile prevalent in the coating chamber changes with respect to the ambient installation pressure from an excess pressure at the coating medium injection zone to a vacuum at the suction zone, both pressure zones, positive and negative being exploitable as pressure differential source with respect to pressure of the surroundings of the coating chamber.

In accordance with the present invention, the pressure differential between the pressure in the coating chamber and the ambient pressure is advantageously employed as a "passive" source of differential pressure for surrounding the electrodes with a gas flow thereby affording the possibility of substantially shorter conduit lengths. In this connection, from the electrode zone, the conduit needs merely to extend to a place of the outrigger or cantilever arm that has free communication with the surroundings. This, in some practical cases, can already be a zone or area disposed in radial opposition to the coating chamber at the arm. Moreover, there is no need to provide for a "active" pressure source such as, for example, a compressor or the like.

Accordingly, it is an object of the present invention to provide an electrode arrangement for a coating installation which is simple in construction and therefore relatively inexpensive to manufacture.

Another object of the present invention resides in providing an electrode arrangement for a coating installation which functions reliably under all operating conditions.

A still further object of the present invention resides in providing an electrode arrangement for a coating installation which does not require the provision of an active pressure source.

These and other objects, features, and advantages of the present invention will become more apparent from the following description when taken in connection with the accompanying drawings.

Figure 2:
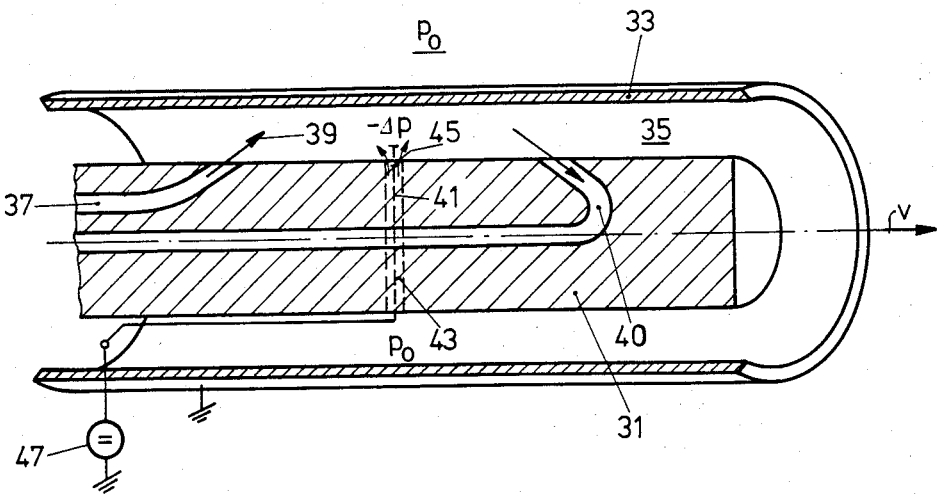

FIG. 1 is a partially schematic cross-sectional view of an electrode arrangement comprising an electrode conventionally surrounded with a gas flow by a conduit arrangement, by virtue of the provision of a differential pressure source; and FIG. 2 is a partially schematic cross-sectional view of an electrode arrangement according to the present invention mounted in a coating installation for coating an interior of an article such as a can body.

Referring now to the drawings wherein like reference numerals are used throughout the various views to designate like parts and, more particularly, to FIG. 1, according to this figure, a coating chamber 5 is defined between a supporting member 1 e.g. a mandrel-like arm and a body or article 3 to be coated, with a jet of coating medium being injected against the article or body 3 through the coating chamber 5 from a coating medium supply or feed conduit 7 provided, for example, at the supporting member 1, with the coating medium being, for example, a coating powder or a coating varnish or liquid laquer. An electric field E is applied to the body 3 to be coated, with the electric field E being applied downstream of the feed or supply conduit 7, and with the field E having at least one component directed or oriented in a direction towards the body 3. The field E is applied by connecting a high voltage source 13 between the body 3, which acts as one electrode, and a counter electrode 11, formed as a wire electrode, provided at the supporting member 1. Consequently, in dependence upon a space between the body 3 and the counter electrode 11, a high electric field E is produced therebetween. An electrode tip 15, defined by the end of the electrode 11, may, as illustrated in FIG. 1 of the drawings, either project beyond the supporting member 1 or, in certain cases, merely extend to a position directly below a surface 17 of the supporting member 1 facing the coating chamber 5.

The conduit arrangement, disposed in an area or zone of the electrode tip 15 of the electrode 11, includes a conduit 19, with the wire electrode being preferably coaxially guided or mounted in the conduit 19 at a spacing with respect to a wall 21 of the conduit 19. The conduit 19 is connected with a pressure source 23 at an end thereof opposite the end terminating in the coating chamber 5. The pressure source 23 produces a pressure differential $\Delta p$ with respect to a pressure $p_{15}$ in a region of the coating chamber 5 in which the electrode tip projects, whereby particles of the coating medium, accumulating in a zone or area of the electrode tip 15, are, in dependence upon the nature of the arithmetic sign of the pressure difference $\Delta p$, either suctioned off through the conduit 19 or blown or blasted back into the coating chamber against the body 3.

As shown in FIG. 2, in another embodiment of an installation for an internal coating of articles such as, for example, can bodies, as well as a coating of longitudinal weld seams thereof, the supporting member is fashioned as an outrigger or cantilever arm 31 projecting mandrel-like into the can bodies to be coated, with the can bodies 33 travelling in a continuous manner over the arm 31 in a direction designated by the arrow v. The arm 31 includes a coating medium feed or supply conduit 37 through which the coating medium such as, for example, a coating powder, varnish or liquid laquer, is injected under pressure as a jet 39 into the coating chamber 35. A suction conduit 40 is provided downstream of the feed or supply conduit 37 and is adapted for suctioning off coating material dropping from the can body 33 or excess coating material. In this connection, the suction conduit is exposed to a vacuum.

A wire electrode is disposed in a zone or area of the coating chamber 35 between the conduits 37, 40 in such a position that a vacuum $-\Delta p$ exists in the region of the electrode tip 45 with respect to the ambient pressure $p_0$, due to the vacuum in the conduit 40. The wire electrode 41 coaxially extends through a passage bore 43 which bore terminates at one end in the coating chamber 35 and, at the other end, in the arm 31 at a position wherein substantially ambient pressure $p_0$ exists e.g. radially on the opposite side of the arm 31. Consequently, an air circulation is produced from the conduit 43 into the coating chamber 35 as illustrated in FIG. 2 thereby preventing coating material from being deposited in a zone or area of the electrode tip 45 of the wire electrode 41. As with the embodiment of FIG. 1, the electrode tip 45 may either project into the coating chamber 35 or be disposed at a position directly below an opening of the conduit 43 into the coating chamber 35. The electrode 41 may be connected, for example, with one pole of a voltage source 47. The other pole of the voltage source is connected to a ground which is of the same potential at which the can body 33 is maintained.

By virtue of the above-noted features of the present invention, the coating material is prevented from accumulating on points of discontinuity of the electrode, which electrode is constructed for maximally high local field strengths.

While I have shown and described several embodiments in accordance with the present invention, it is understood that the same is not limited thereto but is susceptible of numerous changes and modifications as known to one having ordinary skill in the art, and I therefore do not wish to be limited to the details shown and described herein, but intend to cover all such modifications as are encompassed by the scope of the appended claims.

I claim:

1. A coating installation including a coating chamber in which a coating medium is propelled against an article to be coated, feeding means for feeding the coating medium into the coating chamber by a gas under pressure, thereby providing for a differential pressure within said chamber with respect to an ambient pressure around said installation outside said chamber, electrode means disposed within said coating chamber and connected to a means for applying an electric field between said electrode means and the article, conduit means leading into said chamber in an area of the electrode means and communicating with a pressure source to provide a gas stream to prevent the coating medium from affecting the electrode means, and wherein said pressure source is said differential pressure within said chamber with respect to the ambient pressure at a region of the coating installation outside said chamber providing for a purging gas stream between said chamber and said region.

2. A coating installation according to claim 1, wherein the electrode mean includes a wire electrode axially arranged within said conduit means and extending at one end thereof beyond an end of said conduit means.

3. A coating installation according to claim 1, wherein said feeding means comprises an inlet means for injecting said coating medium under positive driving pressure and a suction means for collecting excess coating medium under negative suction pressure, said electrode means and said conduit means being arranged between said inlet means and said suction means at an area of negative differential pressure with respect to said region.

* * * * *